US010561227B2

(12) United States Patent
Record et al.

(10) Patent No.: US 10,561,227 B2
(45) Date of Patent: Feb. 18, 2020

(54) MULTI-DIRECTIONAL SELF-DIRECTING HOLSTER AND CLIP DEVICE

(71) Applicants: Jason Record, Cumberland, ME (US); Todd Sniper, Portland, ME (US)

(72) Inventors: Jason Record, Cumberland, ME (US); Todd Sniper, Portland, ME (US)

(73) Assignee: Jason Record, Cumberland, ME (US)

( * ) Notice: Subject to any disclaimer, the term of this patent is extended or adjusted under 35 U.S.C. 154(b) by 0 days.

(21) Appl. No.: 16/067,308

(22) PCT Filed: Jan. 11, 2017

(86) PCT No.: PCT/US2017/012897
§ 371 (c)(1),
(2) Date: Jun. 29, 2018

(87) PCT Pub. No.: WO2017/123563
PCT Pub. Date: Jul. 20, 2017

(65) Prior Publication Data

US 2019/0014893 A1 Jan. 17, 2019

Related U.S. Application Data

(60) Provisional application No. 62/277,705, filed on Jan. 12, 2016.

(51) Int. Cl.
*A45F 5/02* (2006.01)

(52) U.S. Cl.
CPC ..... *A45F 5/021* (2013.01); *A45F 5/02* (2013.01); *A45F 5/022* (2013.01); *A45F 2005/025* (2013.01); *A45F 2005/026* (2013.01); *A45F 2200/0583* (2013.01)

(58) Field of Classification Search
CPC .. A45F 5/021; A45F 5/02; A45F 5/022; A45F 2005/025; A45F 2005/026; A45F 2200/0583
USPC ..... 224/200, 414, 251, 667, 197
See application file for complete search history.

(56) References Cited

U.S. PATENT DOCUMENTS 449,460 A * 3/1891 Bannister ..... B62J 11/00 224/414
478,092 A * 7/1892 Cushman ..... B62J 11/00 224/414
5,730,342 A * 3/1998 Tien ..... A45F 5/02 224/197
5,992,717 A * 11/1999 Clewes ..... A01K 97/10 224/200
8,141,210 B2 * 3/2012 Colorado ..... A45F 5/02 224/197
D684,104 S * 6/2013 Goldman ..... D12/411
(Continued)

FOREIGN PATENT DOCUMENTS

KR 200159851 Y1 11/1999
KR 2020000002273 U 2/2000
(Continued)

*Primary Examiner* — Corey N Skurdal
(74) *Attorney, Agent, or Firm* — Jeffrey Joyce, Esq.

(57) ABSTRACT

A clip and holster for holding a canister or similarly dimensioned item, the holster having wave-shaped securing arms with fillet edges that guide the canister into a secured position, and the clip having at least two knobs that support the holster in a number of positions that may be fixed or rotatable.

9 Claims, 14 Drawing Sheets

(56) References Cited

U.S. PATENT DOCUMENTS

| | | | | |
|---|---|---|---|---|
| 2003/0000976 | A1* | 1/2003 | Malhotra | A45F 5/00 224/197 |
| 2003/0098323 | A1* | 5/2003 | Taylor | A45F 5/02 224/197 |
| 2003/0141329 | A1* | 7/2003 | Huang | A45F 5/02 224/197 |
| 2011/0042435 | A1* | 2/2011 | Weng | B62J 11/00 224/414 |
| 2012/0037677 | A1* | 2/2012 | Valiquette | B62J 11/00 224/414 |
| 2013/0270315 | A1 | 10/2013 | Tsai | |

FOREIGN PATENT DOCUMENTS

| | | | |
|---|---|---|---|
| KR | 2020100012831 | U | 12/2010 |
| WO | 2015159181 | A1 | 10/2015 |

* cited by examiner

MULTI-DIRECTIONAL SELF-DIRECTING HOLSTER AND CLIP DEVICE

BACKGROUND INFORMATION

Field of the Invention

The invention relates to holsters and clips that are used to attach items such as bottles and canisters to a user's attire.

Background of the Invention

Holsters and clips are well known and are used with a wide variety of devices such as water bottles, mace sprayers, phones, and tools. Soccer/football referees also frequently use a clip and holster device to hold vanishing sprays that are used in the course of soccer games. The conventional holsters and clips typically secure the item, such as a canister of vanishing spray, in a fixed upright position and use such things as straps, snaps and/or hook-and-loop fasteners to ensure the canister stays in position.

However, in practice a user is often focused on other events when removing and then replacing such a canister. For example, a runner must be focused on her surroundings to avoid injury, and a referee must be focused on the game. In such situations, it is often not practical to use the securing mechanisms that accompany conventional clip and holster devices.

What is needed, therefore, is a clip and holster device that may be affixed in a number of different positions and that directs the canister into the properly secured position regardless of the manner in which user attempts to secure the item.

BRIEF SUMMARY OF INVENTION

The invention is a multi-directional self-directing holster and clip for holding an item, such as a canister, wherein the holster uses curved securing arms having filleted or rounded edges to direct the canister into the proper and secured position, and a number of knobs to allow a user to secure the holster in a desired position or, alternatively, allow the user to freely rotate the holster.

The design of the holster and clip allows a user to position the holster in the direction, i.e., vertical, horizontal with the opening to the left, horizontal with the opening to the right, etc., that is most advantageous for the user's individual preference and method of use. The holster's curved securing arms with filleted edges guide the canister into the secured position from a wide range of insertion angles and positions. For example, if the user is using the device on a football/soccer field, after using the canister the user must run down the field as play resumes and he needs only apply pressure to the canister against the holster, either from a top-down direction that pushes the bottom of the canister into the top of the holster, or from the side of the can directly against the opening between the sets of securing arms parallel to the secured position, and the securing arms and fillet edges will guide the canister into the secured position.

Together the holster and clip provide a device that allows a user to secure an item with minimal effort or attention, so that the user may focus on any number of other activities.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
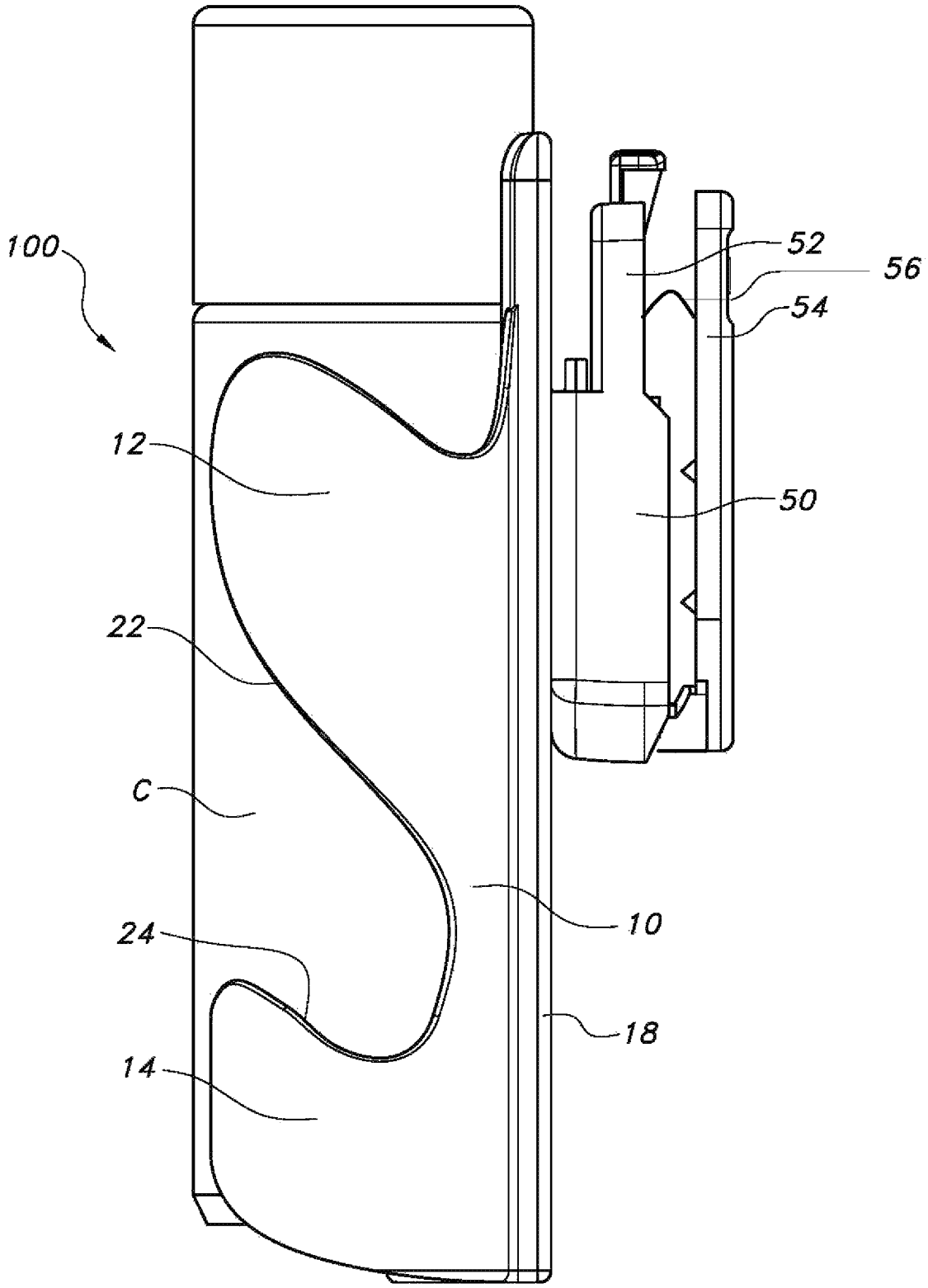
FIG. 1 is a side view of the device according to the invention holding a canister.

FIG. 1 illustrates the device 100 according to the invention including a holster 10 for holding a bottle or canister C and a clip 50 for securing the holster to a user's clothing. The disclosure will discuss the invention in terms of its use with a canister, however, it is understood that the device may be used with any number of similarly dimensioned items and is not limited to use with canisters.

FIGS. 2-7 illustrate the holster 10, including upper securing arms 12, lower securing arms 14, a base 16 and a spine 18. The spine 18 has a curved front surface 28 that is shaped to fit the curve of the canister C. The securing arms 12, 14, protrude outward from the spine 18 in a curved manner that guides and secures the canister C. The outer edges 22, 24 of the securing arms are filleted, or rounded, to further guide the canister C into position so as to facilitate easy insertion of the canister C from a number of directions.

Figure 3:
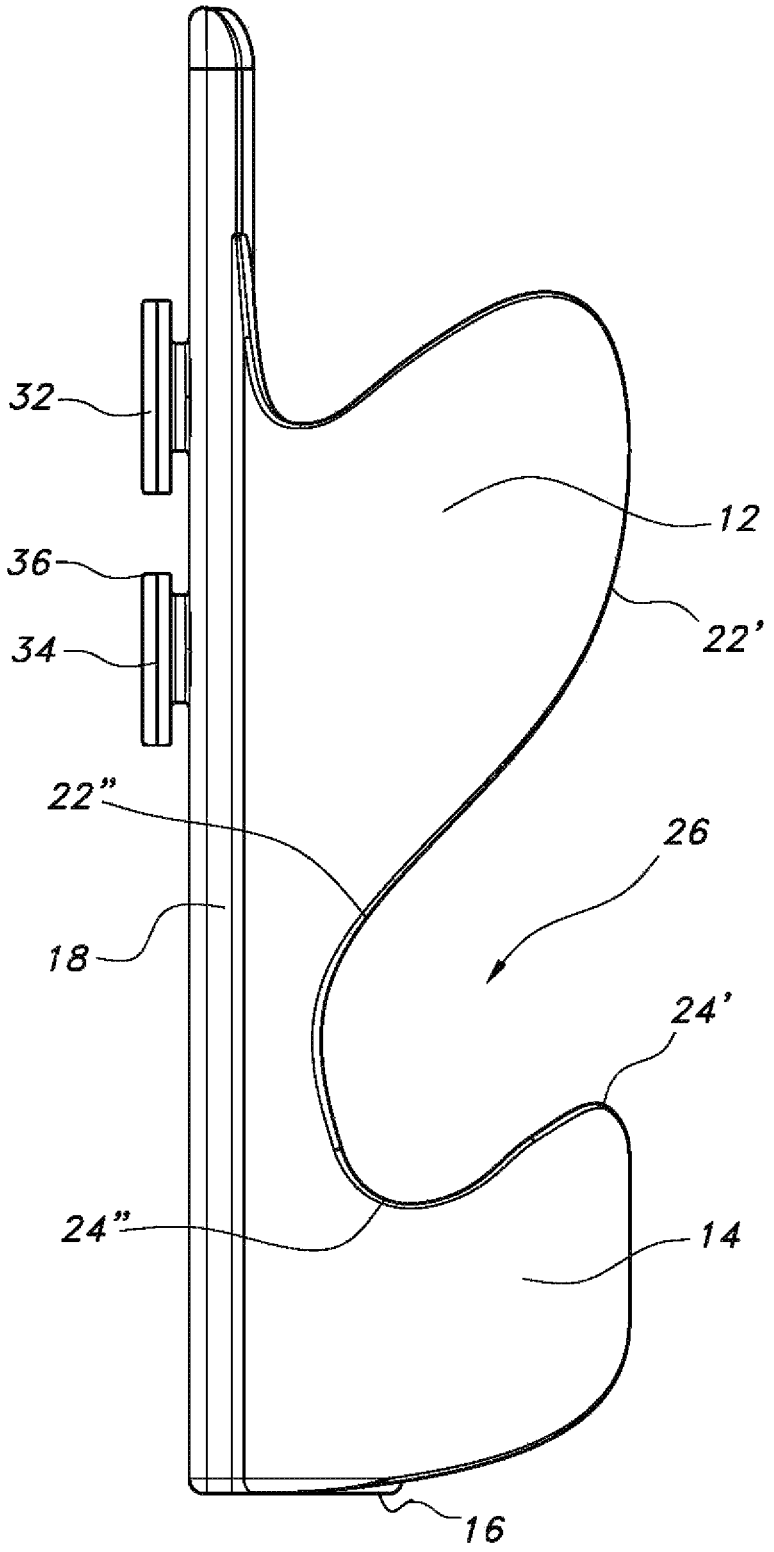
FIG. 3 is a side view of the holster.
Figure 4:
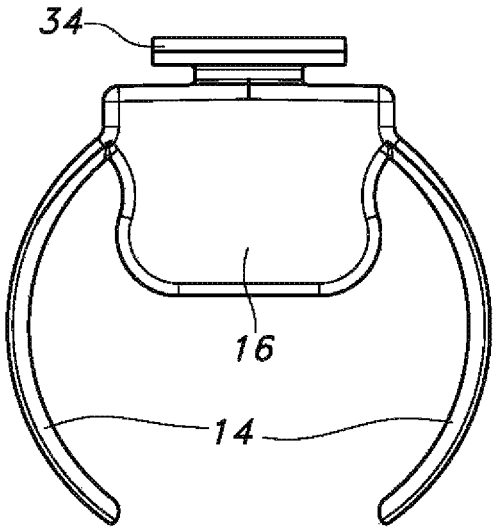
FIG. 4 is a bottom view of the holster.
Figure 5:
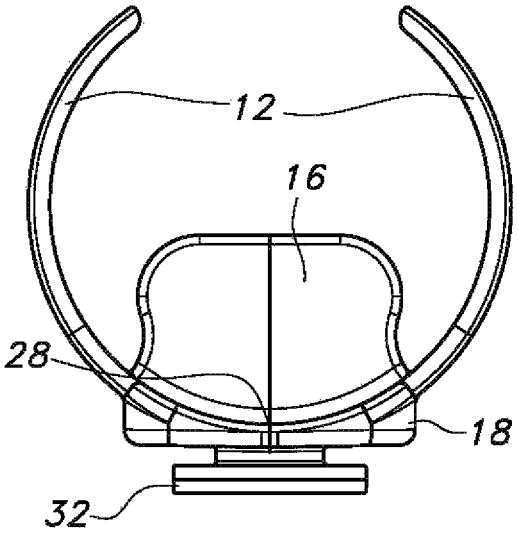
FIG. 5 is a top view of the holster.
Figure 7:
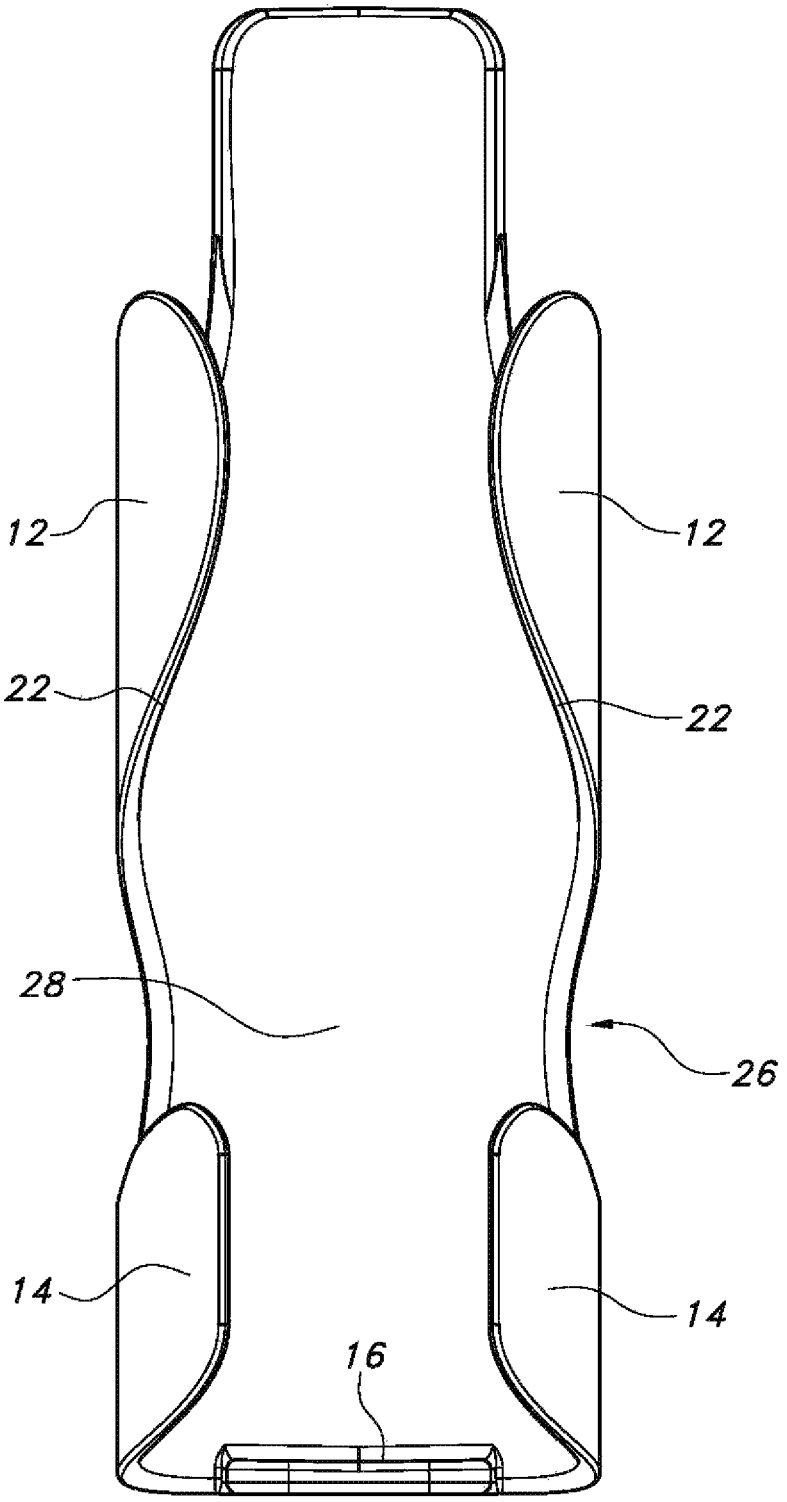
FIG. 7 is a front view of the holster.
Figure 9:
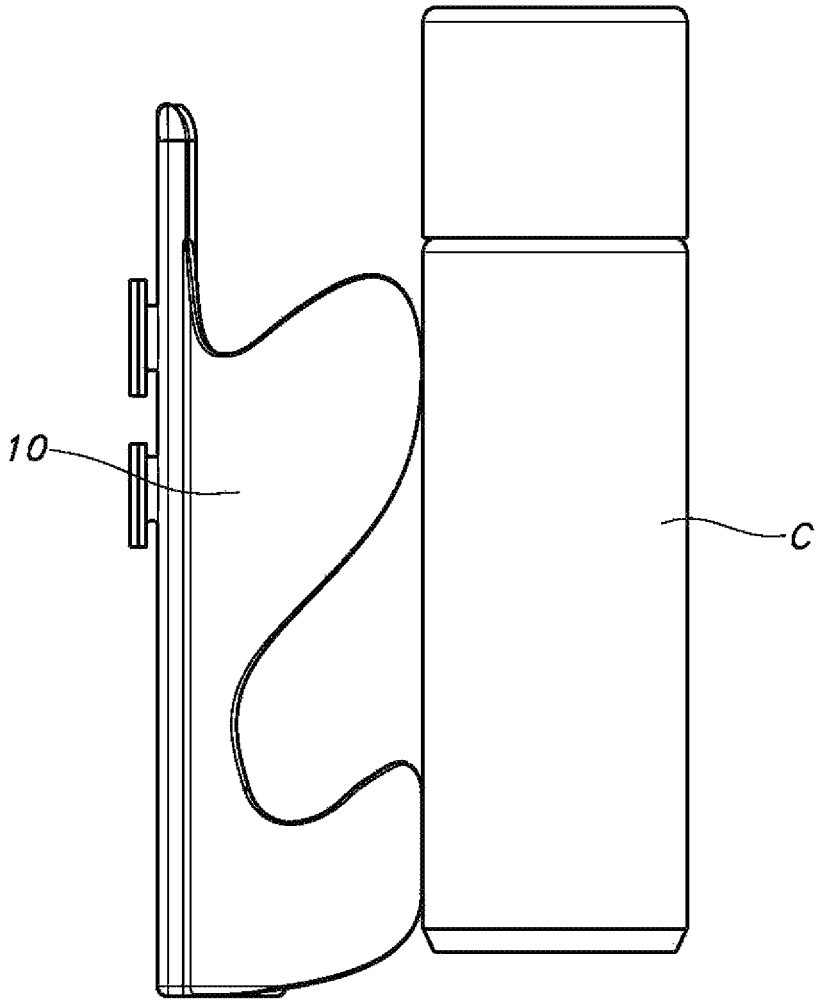
FIG. 9 is a side view of the holster showing the canister being inserted from the side.
Figure 10:
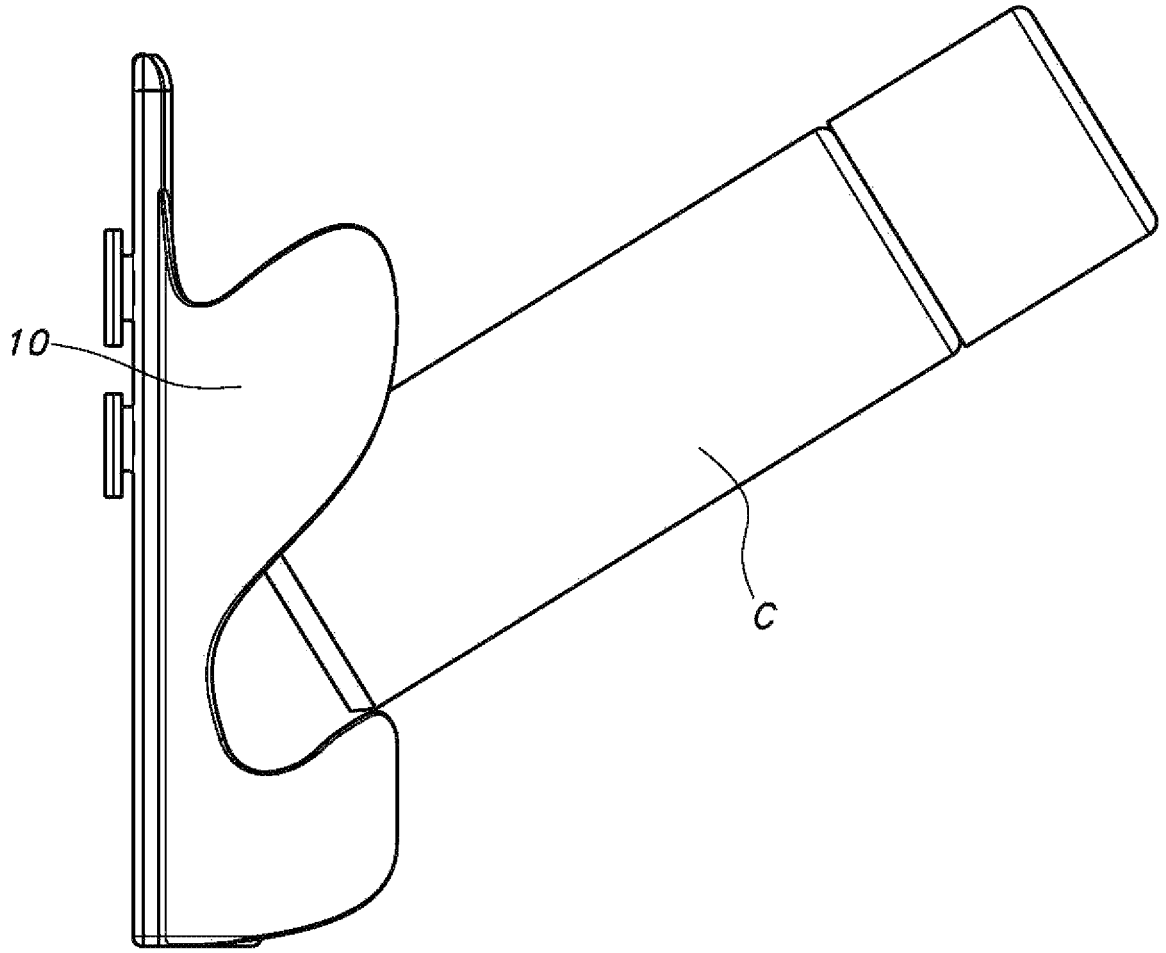
FIG. 10 is a side view of the holster showing the canister being inserted base-first from an inclined angle.
Figure 11:
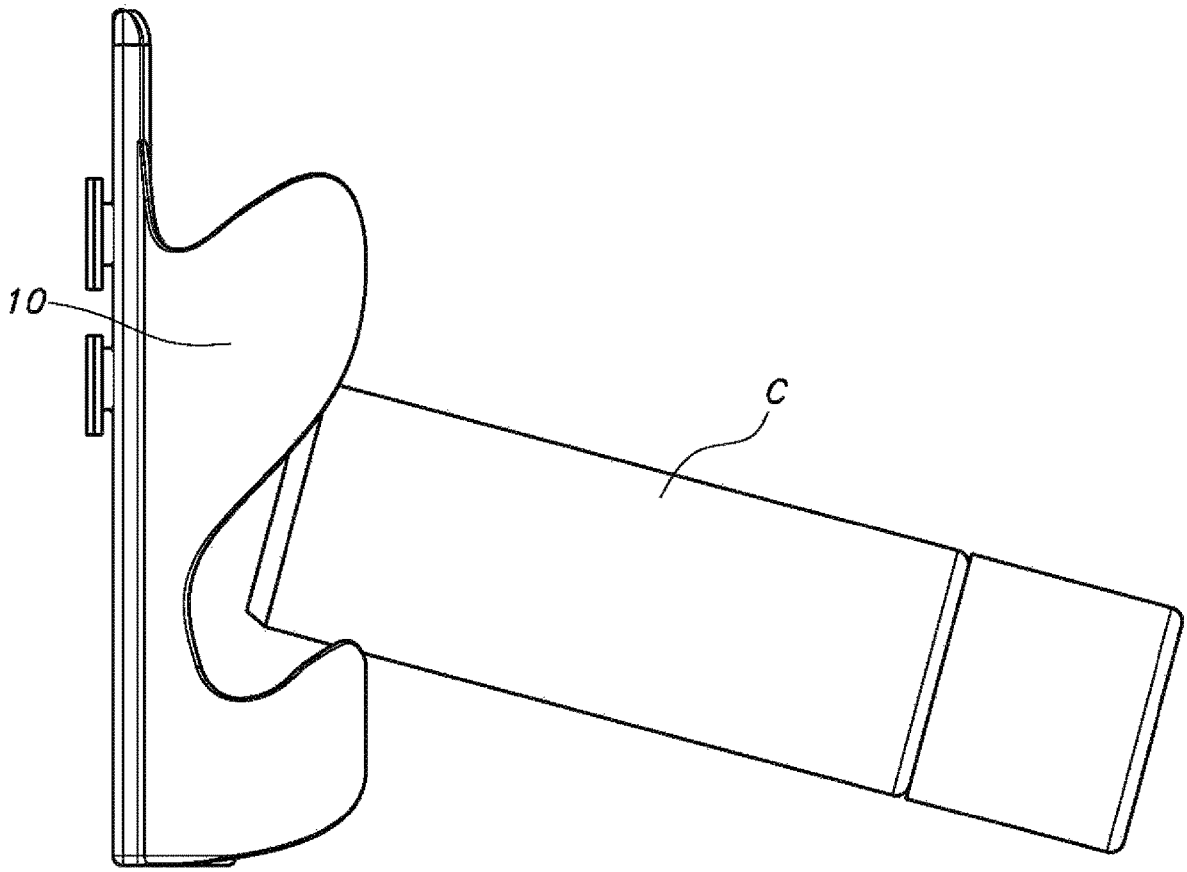
FIG. 11 is a side view of the holster showing the canister being inserted base-first from a declined angle.
Figure 12:
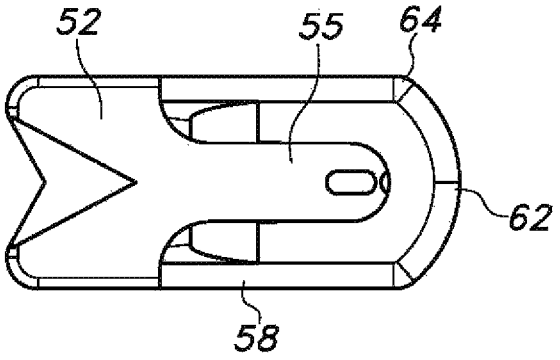
FIG. 12 is a front view of a portion of the clip.
Figure 13:
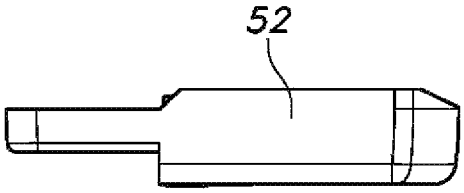
FIG. 13 is a side view of a portion of the clip.
Figure 14:
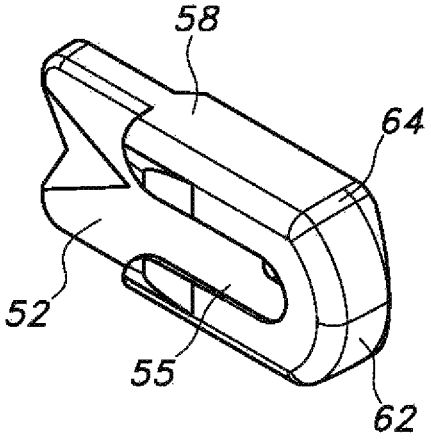
FIG. 14 is a perspective view of a portion of the clip.
Figure 15:
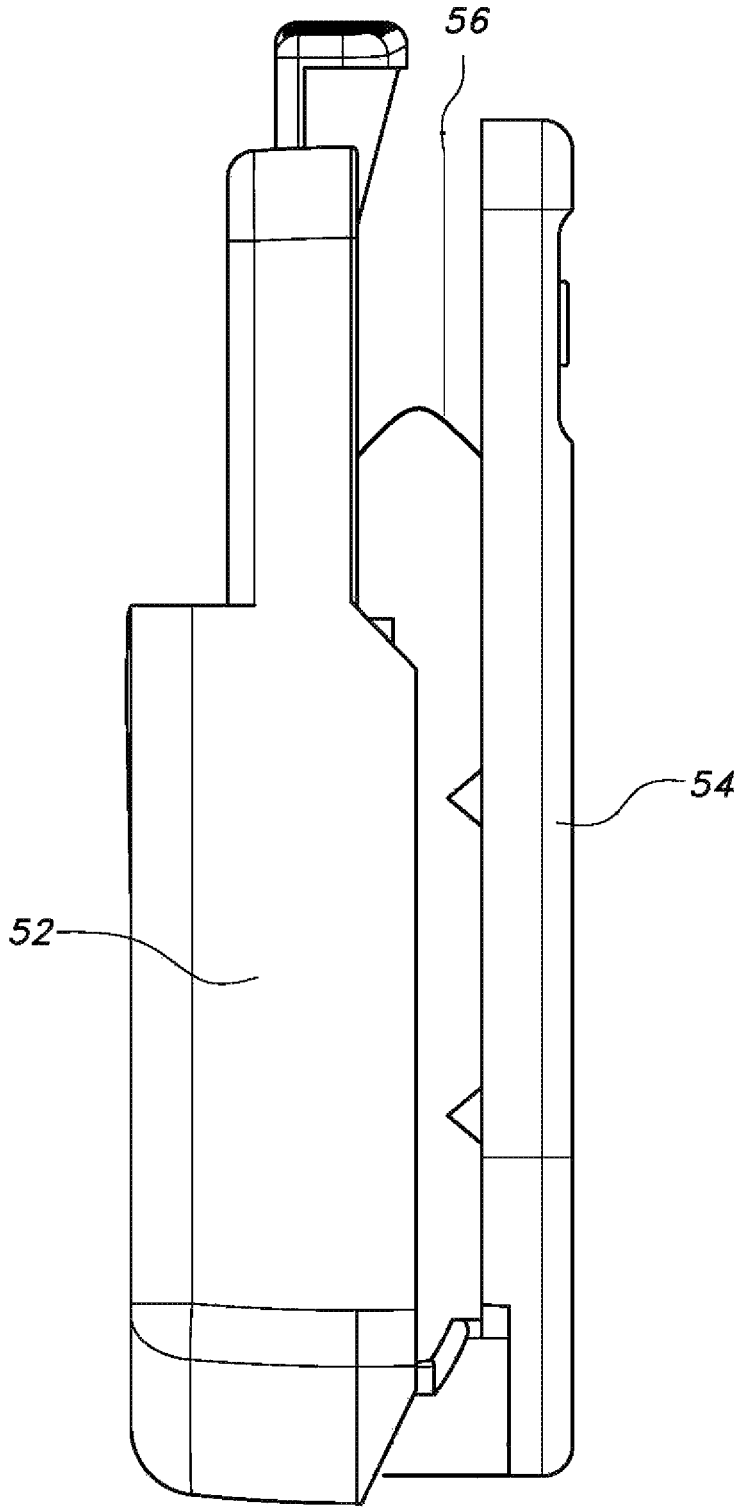
FIG. 15 is a side view of the clip.

More specifically, the securing arms 12, 14, are curved in two ways. First, as best shown in FIG. 3, the securing arms 12, 14, are curved upward in a wave-like manner. These curves help to guide the canister C towards the base 16, particularly when the canister C is inserted into the holster base-first, examples of which are shown in FIGS. 10 and 11. Second, as best shown in FIGS. 5 and 7, the securing arms initially curve outward away from the spine 18 before curving inward, leaving an opening to allow for side insertion, an example of which is shown in FIG. 9, and easy removal of the canister C. In the example shown in FIG. 9, the user must simply apply force to the side of the canister C in the direction of the holster 10.

Figure 2:
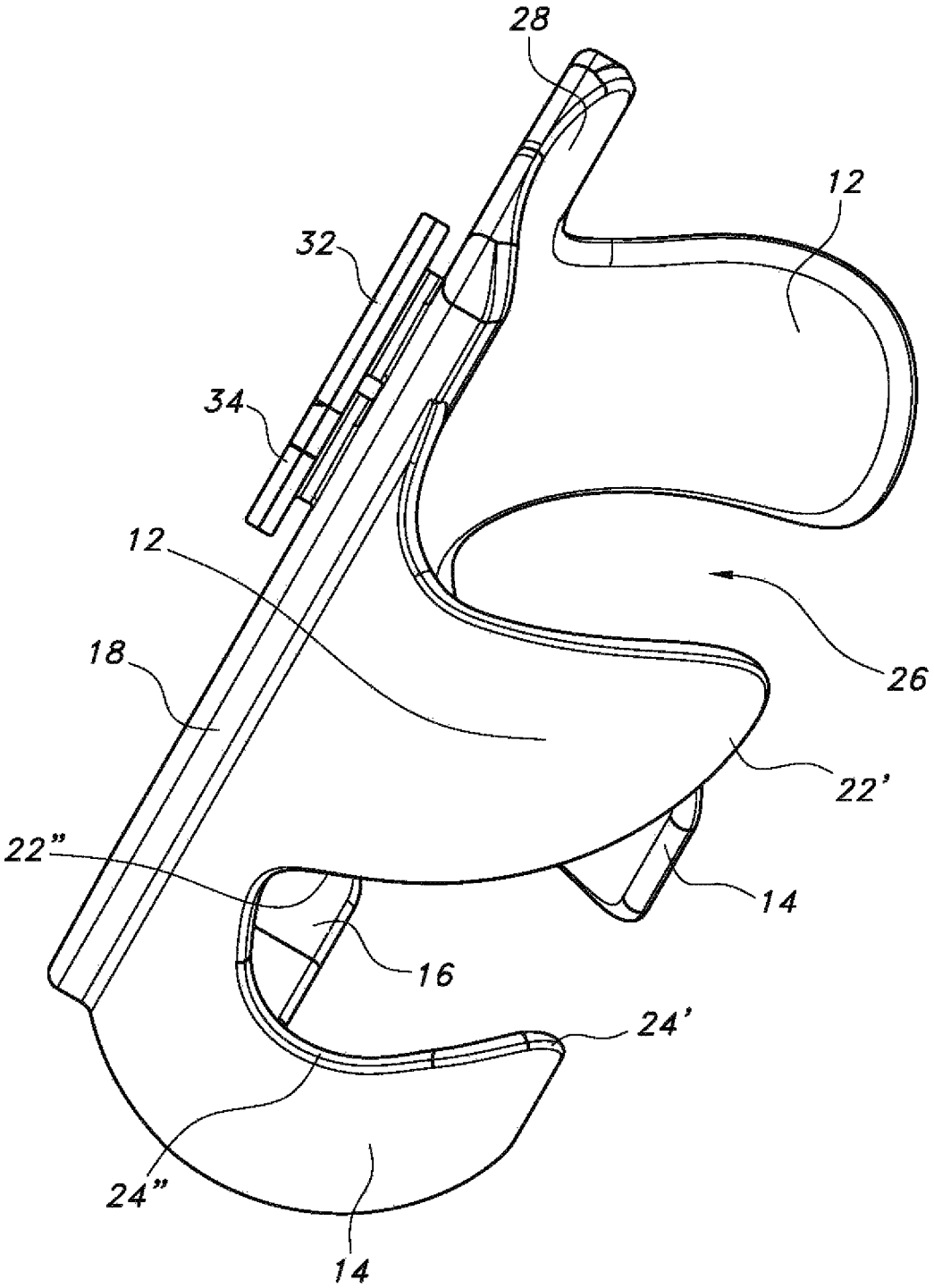
FIG. 2 is a perspective view of the holster.

A space 26, illustrated in FIGS. 2, 3, and 7, is provided between the upper arms 12 and lower arms 14 that is sized to allow the canister C to slide beneath the upper arms 12 but above the lower arms 14, for example during the base-first insertion illustrated in FIGS. 10 and 11, and then snap securely into the secured position above the base 16. For example, if the diameter of the canister C is approximately 1.5 inches, the opening of the space 26 between outer sections 22', 24' of the edges 22, 24, would be approximately 1.75 inches and the space between inner sections 22", 24" of the edges 22, 24 would be approximately 1.0 inch. This allows the canister to be easily inserted between the outer edges 22', 24' and then follow the curve of the arms 22, 24 to the inner edges 22", 24", at which point the base of the canister C contacts the spine 18 and slides into position above the base 16. The curve of the upper arms 12 and filleted edges 22 also allow for angled insertion, similar to that illustrated in FIG. 10, from a position above the upper arms.

Figure 8:
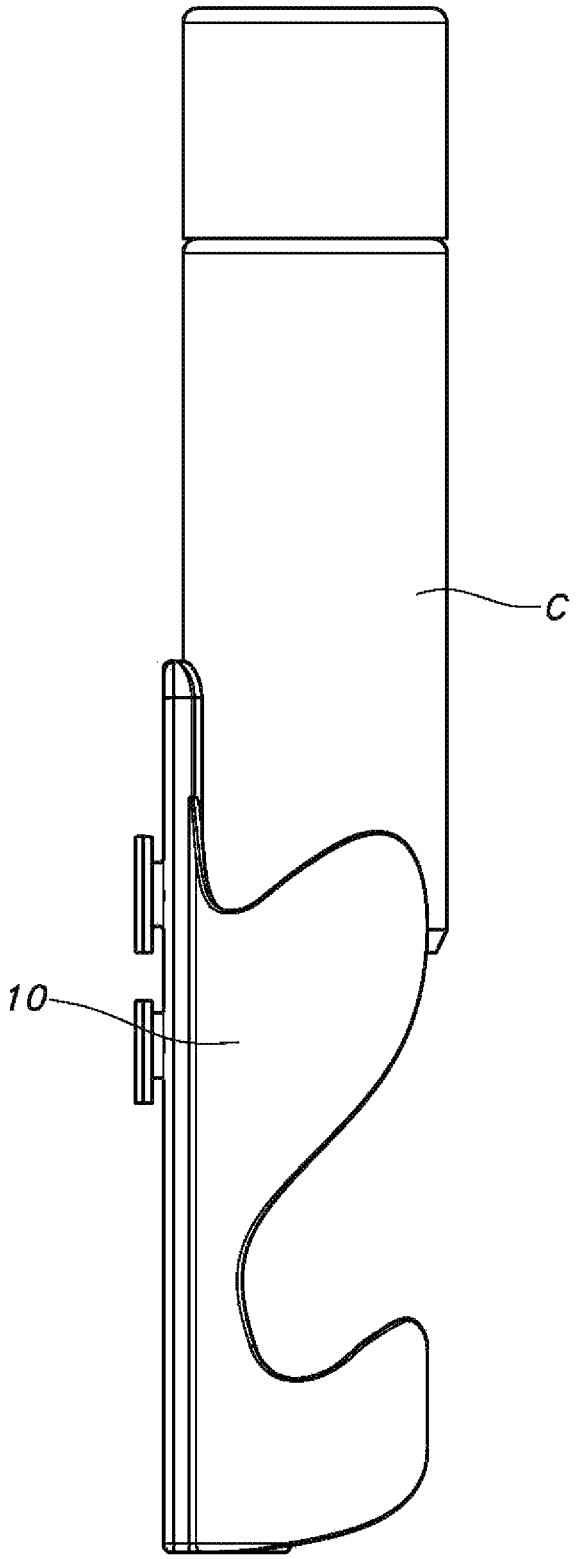
FIG. 8 is a side view of holster showing the canister being inserted from the top.

As mentioned above, the curves of the securing arms 12, 14 and the fillet of the edges 22, 24 allow the canister C to be inserted into the holster 10 from a number of directions and positions. For example, the canister C may be inserted from the top, either straight down as shown in FIG. 8 or from a range of angled directions, similar to the example illustrated in FIG. 10, from the side as shown in FIG. 9, or base-first from a number of angles, examples of which are shown in FIGS. 10 and 11. In each instance, the shape of securing arms 12, 14 direct the canister in to the proper secured position from a wide range of directions and angles of insertion.

In the example shown in FIG. 11, the curves of the upper arms 12 and edges 22, guide the rounded base of the canister C downward, so that even though the base of canister is initially being inserted in the wrong, i.e. upward, direction it is still directed to the secured position. More particularly, the rounded base of the canister C engages the upper arms 12 and, as the user presses the canister C base upward and inward into the narrower opening between the arms, best illustrated in FIG. 7, the edges 22 and curves of the arms 12 guides the canister downward to the space 26, where the canister C slides into the secured position.

Figure 6:
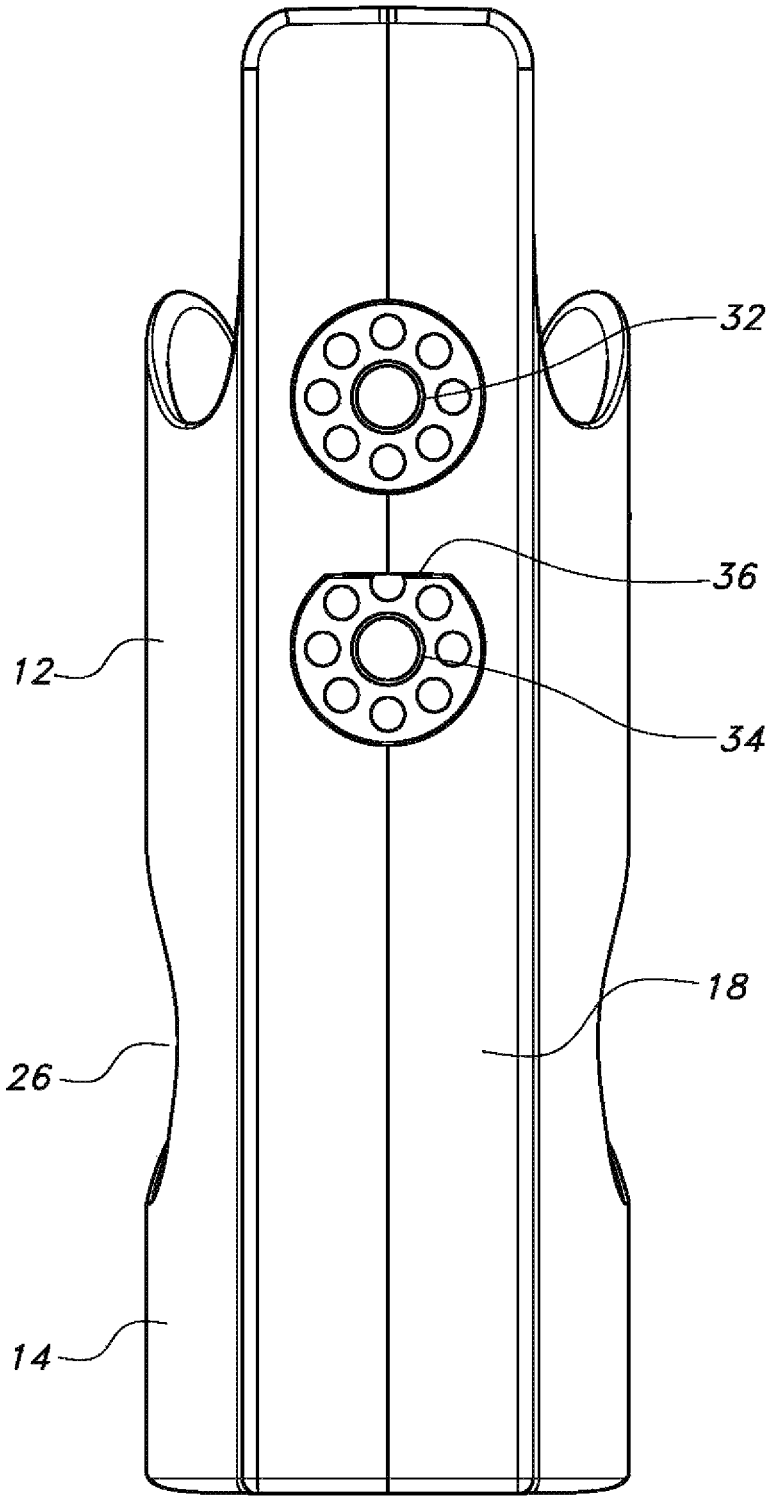
FIG. 6 is a rear view of the holster showing the attachment knobs.

A pair of knobs 32, 34, best illustrated in FIG. 6, are provided on the holster 10 to attach the holster 10 to the clip 50, which is typically secured to a user's clothing, for example, to a user's belt (not shown) or pants pocket (not shown). One knob 32 is rounded while the other knob 34 includes a straight edge 36, which allows the user to choose between securing the holster in a number of locked positions or in a 180-degree rotatable position. In the embodiment shown the knobs 32, 34, are integrated into the holster, however, it is also possible to incorporate the knobs into a separate plate 38, partially shown in FIGS. 17 and 18, or other device (not shown) that is attachable to a holster 10 or other device (not shown), or to another device that is not a holster, through any suitable conventional means, such as, for example, hook and loop fasteners or adhesively.

FIG. 1 and FIGS. 12-18 illustrate the clip 50 which includes a front plate 52, a back plate 54 and a connector 56. As with many conventional clips, it is designed to fit over a belt or into a pocket, with the back plate 54 positioned against the user and the front plate 52 positioned to attach to a device, such as the holster 10. The front plate 52 includes a u-shaped opening 55 that accepts one or both of the knobs 32, 34, and has straight sides 58 and a curved bottom 62. In the embodiment shown, the connector 56 is a metal spring clip.

Figure 17:
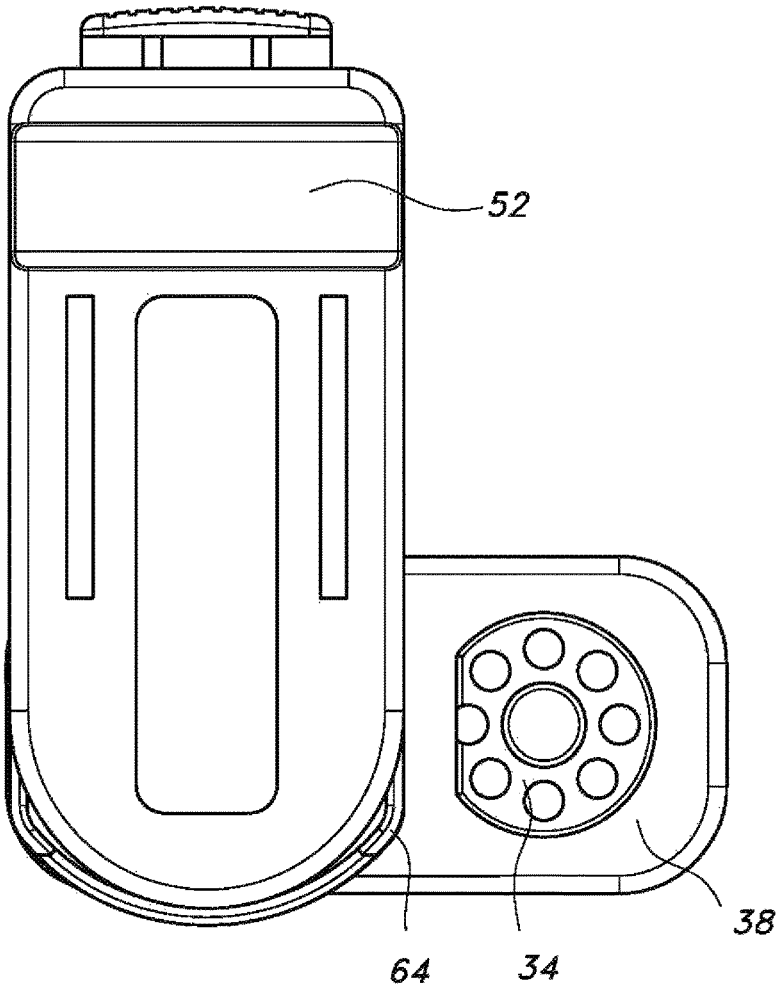
FIG. 17 is a rear view of the clip attached to the rounded knob in a horizontal position.
Figure 18:
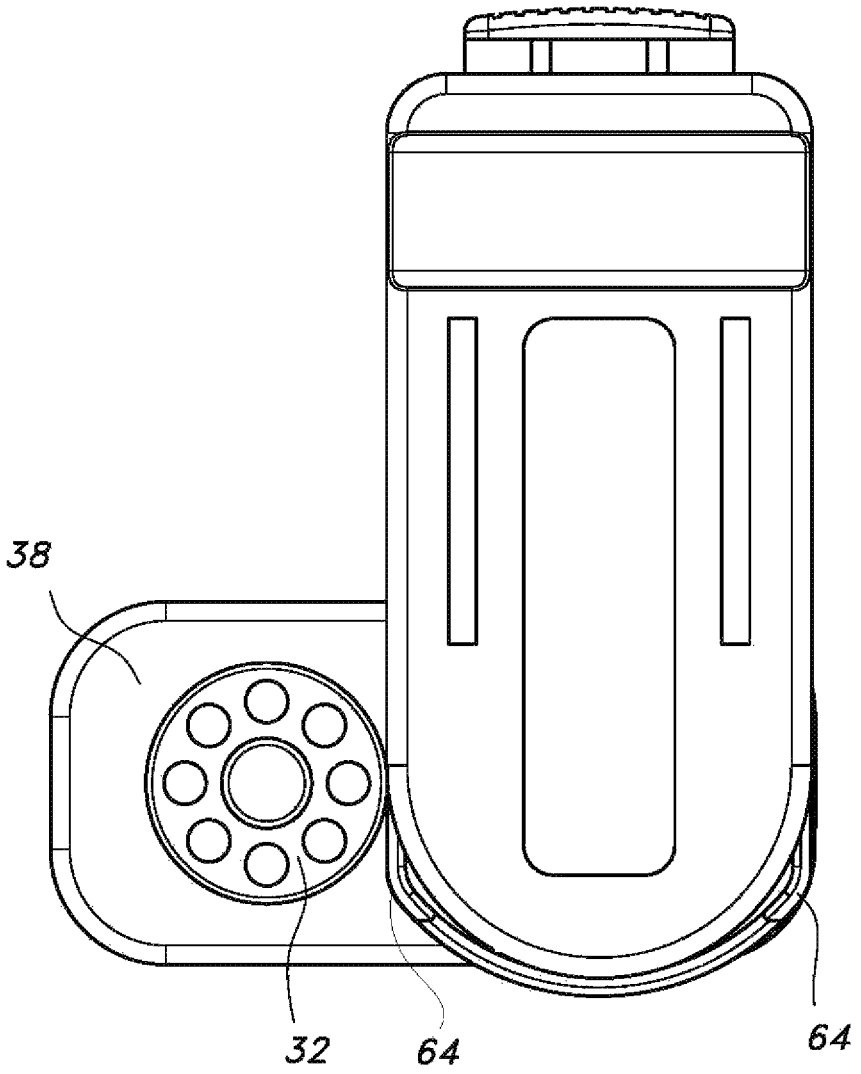
FIG. 18 is a rear view of the clip attached to the rounded knob with a straight edge in a horizontally locked position.

In the embodiment shown, the sides 58 meet the curved bottom 62 at a corner 64. The corner 64 allows the user to lock the holster 10 into a number of fixed positions or, alternatively, to rotate the holster 10 approximately 180 degrees depending upon which knob 32, 34 is/are inserted into the u-shaped opening 55. For example, if the user wishes to lock the holster 10 in a vertical position, he would insert both knobs 32, 34 into the u-shaped opening 55. Alternatively, if the user wishes to lock the holster 10 into a horizontal position, he would insert the knob with the straight edge 34 into the opening 55 as shown in FIG. 18. Using this knob allows the user to lock the holster in a horizontal position facing either left or right. In this configuration the holster 10 cannot rotate because the rounded knob 32 is blocked by the corner 64 and side 58. To attach the holster 10 to the clip 50 in a manner that allows for rotation, the rounded knob 32 is inserted into the opening 55 as shown in FIG. 17. In this configuration, the straight edge 36 of the straight edge knob 34 is positioned towards the corner 64 and is sized to provide enough clearance between the knob 34 and the corner 64 to allow the holster 10 to rotate freely from one side to the other.

Figure 16:
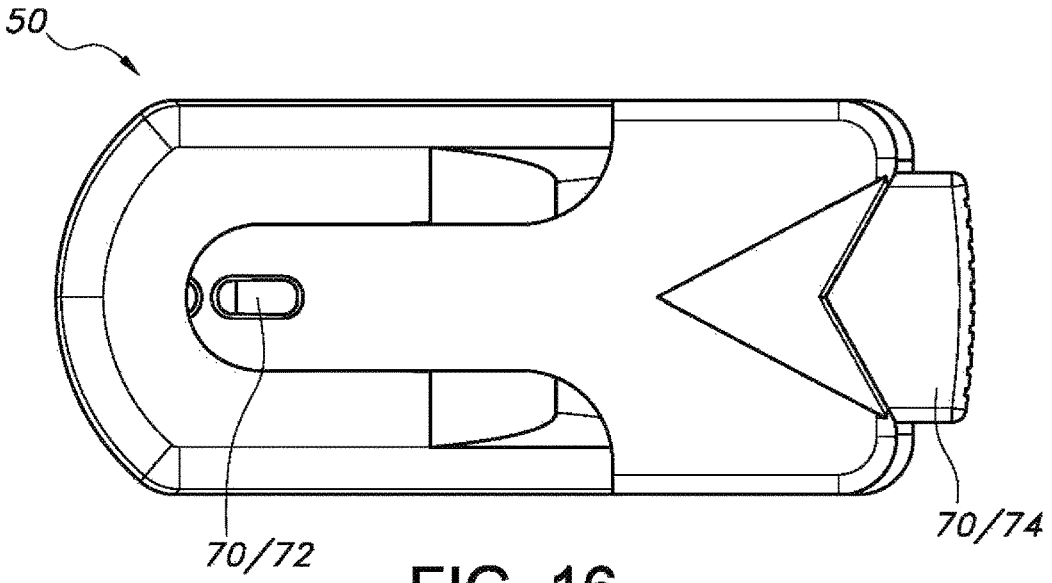
FIG. 16 is a front view of the clip showing the knob receiving mechanism

FIG. 16 illustrates a conventional locking mechanism 70 that is also provided. The locking mechanism 70 has a latch 72 that snaps into the center of one of the knobs 32, 34. A push button 74 allows the user to depress the latch 72 and remove the holster 10 from the clip 50.

It is understood that the embodiments described herein are merely illustrative of the present invention. Variations in the construction of the holster and clip may be contemplated by one skilled in the art without limiting the intended scope of the invention herein disclosed and as defined by the following claims.

What is claimed is:

1. A holster for holding a canister, the holster comprising:

a spine having upper securing arms and lower securing arms, the securing arms first protruding outward and away from the spine and then being curved inward so as to wrap partially around the canister when the canister is inserted into the holster, each of the securing arms having an upper edge that initially curves downwards as it extends away from the spine and then curves upwards; and a base attached to the bottom of the spine;

wherein the canister is insertable into the holster in a vertical or angled direction from a position above or below the securing upper arms or a position above the lower securing arms or inserted in a horizontal direction towards the upper securing arms and lower securing arms; and wherein the upper securing arms and lower securing arms guide the canister into a secured position in the holster above the base and against the spine.

2. The holster of claim 1, further comprising a space between the upper securing arms and lower securing arms, the space sized to allow the canister to slide between the upper and lower arms for insertion into the holster.

3. The holster of claim 2, wherein the spine has a front surface that is curved to fit the shape of the canister.

4. The holster of claim 1, wherein the upper securing arms and lower securing arms have fillet edges that help guide the canister into a secured position against the spine and above the base.

5. The holster of claim 4, wherein the upper edge of the upper securing arms create an unencumbered opening such that the canister may be inserted from above the upper securing arms.

6. The holster of claim 5, wherein the upper edges of the upper securing arms, after initially curving downward as they extend away from the spine and then curving upward, curve downward to outer edges of the upper securing arms, the outer edges continuing to run towards the lower securing arms; and wherein the shape of the opening between the outer edges of the upper securing arms and the upper edges of the lower securing arms is curved to guide the canister into a secured position when inserted between the upper securing arms and lower securing arms.

7. The holster of claim 6, wherein the upper edges of the lower securing arms, after initially curving downward as they extend away from the spine and then curving upward in a wave-like manner, curve downward to outer edges of the lower securing arms; and wherein the shape of the lower securing arms guide the canister into a secured position when the canister is inserted between the upper securing arms and lower securing arms.

8. A clip for holding a holster, the clip comprising:

a front plate and a back plate that are connected by a connector, the front plate having straight sides, a rounded bottom, and having a u-shaped opening;

a holster attachment comprising a plate with at least a first knob and a second knob, the first knob and second knob each sized to fit in the u-shaped opening and wherein the first knob is rounded and the second knob has at least one straight side;

wherein inserting the first knob and the second knob into the u-shaped opening connects the holster attachment in a locked vertical orientation; and wherein inserting the first knob but not the second knob into the u-shaped opening secures the front plate to the holster attachment in a manner that allows for at least 180 degrees of rotation; and wherein inserting the second knob but not the first knob into the u-shaped opening secures the front plate to the holster attachment such that the holster attachment is secured in a fixed horizontal position extending in either a right or left direction relative to the front plate.

9. A clip and holster for holding a canister, the clip and holster comprising:

the clip having a front plate and a back plate that are connected by a connector, the front plate having a rounded bottom and a u-shaped opening;

the holster having a spine that includes a front side and a back side, the front side including at least one set of securing arms for securing the canister and the back side having at least a first knob and a second knob, each of the first knob and second knob sized to fit in the u-shaped opening and wherein the first knob is rounded and the second knob has at least one straight side;

wherein inserting the first knob and the second knob into the u-shaped opening connects the holster to the clip in a fixed vertical orientation; and wherein inserting the first knob but not the second knob into the u-shaped opening secures the front plate to the holster attachment in a manner that allows for at least 180 degrees of rotation; and wherein inserting the second knob but not the first knob into the u-shaped opening secures the front plate to the holster attachment such that the holster attachment is secured in a fixed horizontal position extending in either a right or left direction relative to the front plate.

* * * * *